US005147135A

United States Patent [19]

List et al.

[11] Patent Number: 5,147,135

[45] Date of Patent: Sep. 15, 1992

[54] CONTINUOUSLY OPERATING MIXING KNEADER

[75] Inventors: Jorg List, Pratteln; Walther Schwenk, Kaiseraugust; Winfried Dotsch, Pratteln; Pierre Liechti, Muttenz, all of Switzerland

[73] Assignee: List AG, Switzerland

[21] Appl. No.: 683,328

[22] Filed: Apr. 10, 1991

[30] Foreign Application Priority Data

Apr. 11, 1990 [CH] Switzerland ..... 01-244/90

[51] Int. Cl.[5] ..... B01F 7/00

[52] U.S. Cl. ..... 366/303; 366/99

[58] Field of Search ..... 366/302, 303, 304, 307, 366/309, 306, 99, 98, 97, 325, 315, 317

[56] References Cited

U.S. PATENT DOCUMENTS

| | | | |
|---|---|---|---|
| 3,880,407 | 4/1975 | List | 366/99 |
| 4,775,243 | 10/1988 | Baumgartner | 366/303 |
| 4,826,324 | 5/1989 | Kunz | 366/307 |
| 4,889,431 | 12/1989 | Liechti | 366/303 |

*Primary Examiner*—Robert W. Jenkins
*Attorney, Agent, or Firm*—Bachman & LaPointe

[57] ABSTRACT

In the case of a continuously operating mixing kneader for the thermal or chemical treatment of products in liquid, pasty and/or pulverulent state in a housing, there is arranged in this housing, running axially, a kneader shaft (20), which is equipped with disk elements (25) and kneading bars (40) and rotates about an axis of rotation (z). Said kneader shaft effects the transporting of the product in the direction of transport (x). Between the disk elements (25) there are provided kneading counter-elements (33), fixed to the housing (1), the disk elements (25) being arranged furthermore in disk planes (42) perpendicularly to the kneader shaft and forming between them free sectors, which create kneading chambers with the disk plane (42) of adjacent disk elements (25). In this arrangement, the kneading bars (40) are intended to be arranged on a positive or negative offset line (43 or 44) in the kneading chambers between two disk planes (42). In the case of a positive offset line (43), each kneading bar (40) respectively assigned to two disk elements (25) is followed, counter to the direction of rotation (z), by a kneading bar assigned to the next two disk elements of the kneading chamber (28) following in the direction of transport (x), whereas the negative offset line (44) runs in the direction of rotation (z) and the direction of transport (x).

12 Claims, 11 Drawing Sheets

CONTINUOUSLY OPERATING MIXING KNEADER

BACKGROUND OF THE INVENTION

The invention relates to a continuously operating mixing kneader for the thermal treatment of products in liquid, pasty and/or pulverulent state in a housing, there being arranged in this housing, running axially and concentrically, a kneader shaft, which is fitted with disk elements and kneading bars, rotates about an axis of rotation and effects the transporting of the product in the direction of transport, and there being provided between the disk elements kneading counter-elements, fixed to the housing, the disk elements being arranged furthermore in disk planes perpendicularly to the kneader shaft and forming between them free sectors, which create kneading chambers with the disk plane of adjacent disk elements.

A generally horizontal mixing kneader normally operates at average product filling levels of between 50% and 80%. This makes it possible to supply or remove gases or vapors during the process.

The basic idea of such a mixing kneader is set out in German Patent Specification 2,349,106. There, a mixing kneader of the abovementioned type is presented, in which disk elements and kneading counter-elements interact very favorably to improve the mixing and kneading action as well as to clean the individual elements Due to the inclined position of individual elements, the axial transporting action is also favorably influenced. However, it has been found that, in spite of the kneading counter-elements, a certain torus formation is possible in the chamber, between two disk planes, that is to say that the product remains at a standstill in the kneading chamber and is not kneaded. In order to counteract this torus formation, German Offenlegungsschrift 3,704,268, for example, already shows transport elements which transport the product better due to an inclined position of a transport bar.

The same also applies to the mixer arms according to German Offenlegungsschrift 3,538,070, which merely provide an additional rearrangement of the layers and intermixing.

SUMMARY OF THE INVENTION

The inventor set himself the object of adapting the arrangement of kneading bars on the kneader shaft systematically to a desired axial transport, a desired filling level profile along the kneader and consequently to a desired dwell time and dwell time distribution as well as to the intensity of the mixing and kneading action.

It leads to the achievement of this object that the kneading bars are arranged on a positive or negative offset line in the kneading chambers between two disk elements, such that, in the case of a "positive" offset line, each kneading bar respectively assigned to two disk elements is followed, counter to the direction of rotation, by a kneading bar assigned to the next two disk elements of the kneading chamber following in the direction of transport, whereas the "negative" offset line runs in the direction of rotation or the direction of transport.

The essential finding of the present invention is that both the transporting rate, and consequently the dwell time, of the product in the mixing kneader and the intensity of the mixing and kneading action are considerably influenced by the arrangement of the kneading bars in relation to the disk elements as well as by the offset of the kneading bars on the kneader shaft. If the kneading bars are arranged on a negative offset line, a pair of disk elements with a kneading bar is followed in the direction of transport and counter to the direction of rotation by a pair of disk elements without a kneading bar. In this region, both the transporting of the product is restrained and the kneading action is reduced, since the kneading is performed here only by the disk elements, possibly interacting with the kneading counter-elements.

In the case of a positive offset line, a pair of disks with kneading bar is followed, seen in the direction of transport and counter to the direction of rotation, by a further pair of disk elements likewise with a kneading bar. The product is passed on, as it were, from the one kneading bar to the other kneading bar, having the effect both of speeding up the transport and of considerably improving the kneading action.

By this alternative arrangement of the kneading bars, allowance can be made for the different flow properties of the products, it is even possible to allow for the changing states of aggregation of the product between an inlet and an outlet By a stronger or weaker backmixing and consequently by a wider or narrower dwell time distribution, chemical reaction processes or mixing and kneading processes, for example, can be influenced in a desired way. For example, brief variations in metering are balanced out.

A further possibility is to influence the filling level profile along the kneader and, for example, achieve a lower filling level locally underneath an exhaust-vapor discharge nozzle, for the purpose of better vapor removal.

The kneader bars are preferably not located in the center between two disk elements, but are arranged in such a way that they run ahead of or behind the disk elements. Whereas with an arrangement of the kneading bar between two disk elements the product remains caught between the disk elements in spite of the kneading action of the kneading bar, with a leading or trailing arrangement the product can adapt to the directional effect of the kneading bar. This can speed up transporting.

The number of disk elements which are arranged around the kneader shaft within a disk plane is of only secondary importance in the present invention.

There are usually three disk elements, which have an angular offset of 120°. However, fewer or more disk elements may also be provided.

A further illustrative embodiment of the invention provides for major free sectors to be formed between the disk elements, likewise improving the axial transport and intermixing in a specific and desired way. In an extreme case, there may even be only one disk element per disk plane on the kneader shaft.

The essential point about this embodiment of the invention is that the major sectors remaining free lie on a positive or negative sector line. These positive or negative sector lines are arranged analogously to the positive or negative offset lines of the kneading bars. That is to say that, in the case of a negative sector line, the major free sectors of adjacent kneading chambers follow one another counter to the direction of rotation, seen against the direction of transport. On the other hand, the major free sectors on the positive sector line follow one another counter to the direction of rotation and in the direction of transport Here too it is clearly evident that the product is transferred from one free-remaining sector to the other and, as a result, transporting is of course speeded up.

Hence it is possible to couple the positive and negative sector lines with the positive and negative offset lines respectively of the kneading bars. This makes every conceivable constellation possible.

Fastest transporting is ensured by combining the arrangement of the kneading bars on a positive offset line and the arrangement of the sectors remaining free on a positive sector line.

The arrangement of kneading bars on a negative offset line and the arrangement of sectors on a negative sector line reduces product transport considerably. A mixture of positive offset line and negative sector line and positive sector line and negative offset line is likewise possible.

Further selective controlling of product transport and kneading action takes place by selecting the number of kneading bars, there again being many conceivable variations. All these variations are intended to be encompassed by the idea of the present invention.

Furthermore, there is also the possibility of designing differing sections within a mixing kneader, in which sections the arrangement of the kneading bars and/or the distribution of the sectors is likewise designed differently, according to requirements. This allows a zonal acceleration or retardation of the product transport, in order to achieve a desired filling level profile.

By means of the present invention it is possible to influence the axial transporting behavior and backmixing (dwell time distribution) of a product in continuous operation and as a function of the flow behavior specifically in a desired way.

BRIEF DESCRIPTION OF THE DRAWINGS

Further advantages, features and details of the invention emerge from the following description of preferred illustrative embodiments as well as with reference to the drawing, in which.

DETAILED DESCRIPTION

Figure 1:
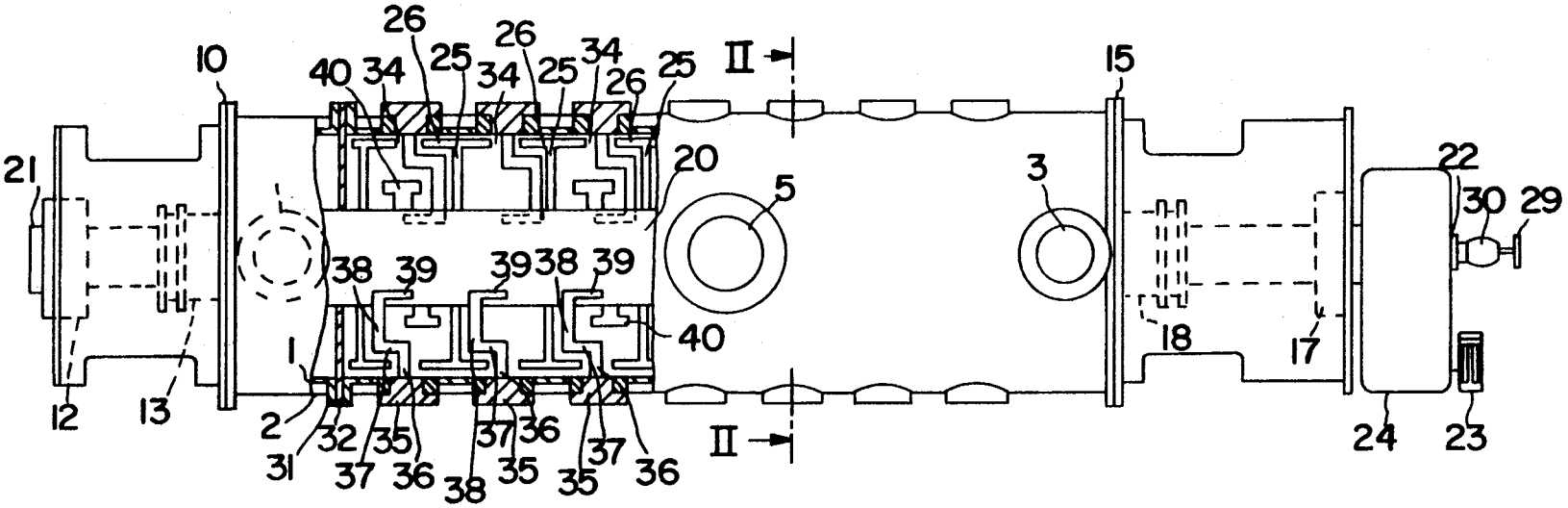
FIG. 1 shows a plan view of a mixing kneader, partially broken away.

According to FIG. 1, a mixing kneader according to the invention has a mostly horizontally arranged housing 1 with end walls 10 and 15. In this housing 1 there rotates a kneader shaft 20, which is supported by the journals 21 and 22 in the bearings 12 and 17 on both sizes of the housing 1. In the end walls 10 and 15 there are stuffing boxes or mechanical seals 13 and 18, which seal the rotating kneader shaft 20 off from the outside in a known way. 2 denotes a heating jacket for heating the housing.

The kneader shaft 20 is preferably also heated or cooled in a known way, an inlet 29 and an outlet 30 for a heating medium being provided at a corresponding sealing head.

The kneader shaft 20 is driven by a motor (not shown in further detail) by means of a V-belt passing over a V-belt pulley 23, a gear mechanism 24 also being connected between V-belt pulley 23 and kneader shaft 20.

The mixing kneader shown in FIG. 1 is intended for continuous operation. During such operation, the product is filled through an inlet nozzle 3 into the interior of the housing and removed via the outlet nozzle 4. Furthermore, various nozzles 5 for removing exhaust vapors are provided on the upper side In order to keep the machine at the optimum filling level, in the range from 50% to 80%, as evenly as possible at various speeds, in the present illustrative example of a mixing kneader an overflow weir 32 is provided ahead of the outlet nozzle 4 in a flange connection 31.

At regular intervals on the rotating kneader shaft 20 there are disk elements 25, on each of which a disk bar 26 is fitted Between the individual sections of disk elements, the disk bars 26 are separated from one another by gaps 34, so that kneading counter-elements 33 can pass through during operation of the kneader shaft 20. For this purpose, the kneading counter-elements 33 are fitted in the housing 1 by means of a flange 35, but can also be directly welded in.

Each kneading counter-element 33 in this case comprises a mounting flange 35, a neck 36, a kneading arm 37, extending approximately axially parallel to the housing wall, a disk scraper 38, arranged parallel to the disk elements, and a shaft scraper 39, bearing against the shaft. In the present illustrative embodiment, the design of the kneading counter-element 33 is chosen only by way of example. Other arrangements are of course also conceivable, such as presented for example in Swiss Patent Specification 661,450, European Patent 0,220,575 and German Patent Specification 2,349,106.

Between the individual planes which are formed by the disk elements 25, there are kneading bars 40 on the kneader shaft.

Figure 2A:
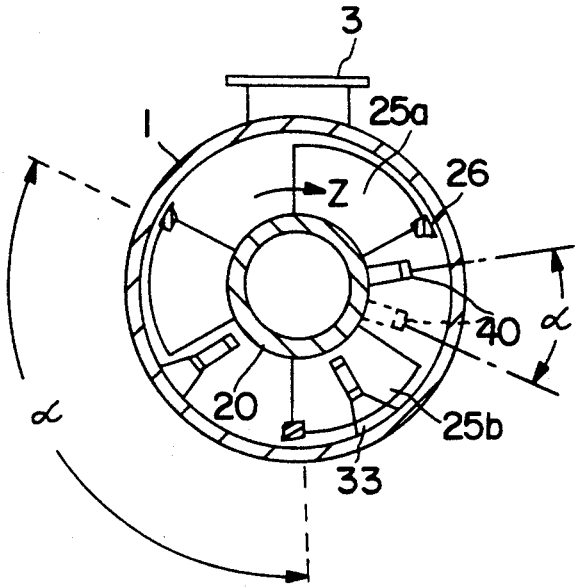
FIG. 2A shows a cross section through the mixing kneader along the line II—II in FIG. 1.
Figure 2B:
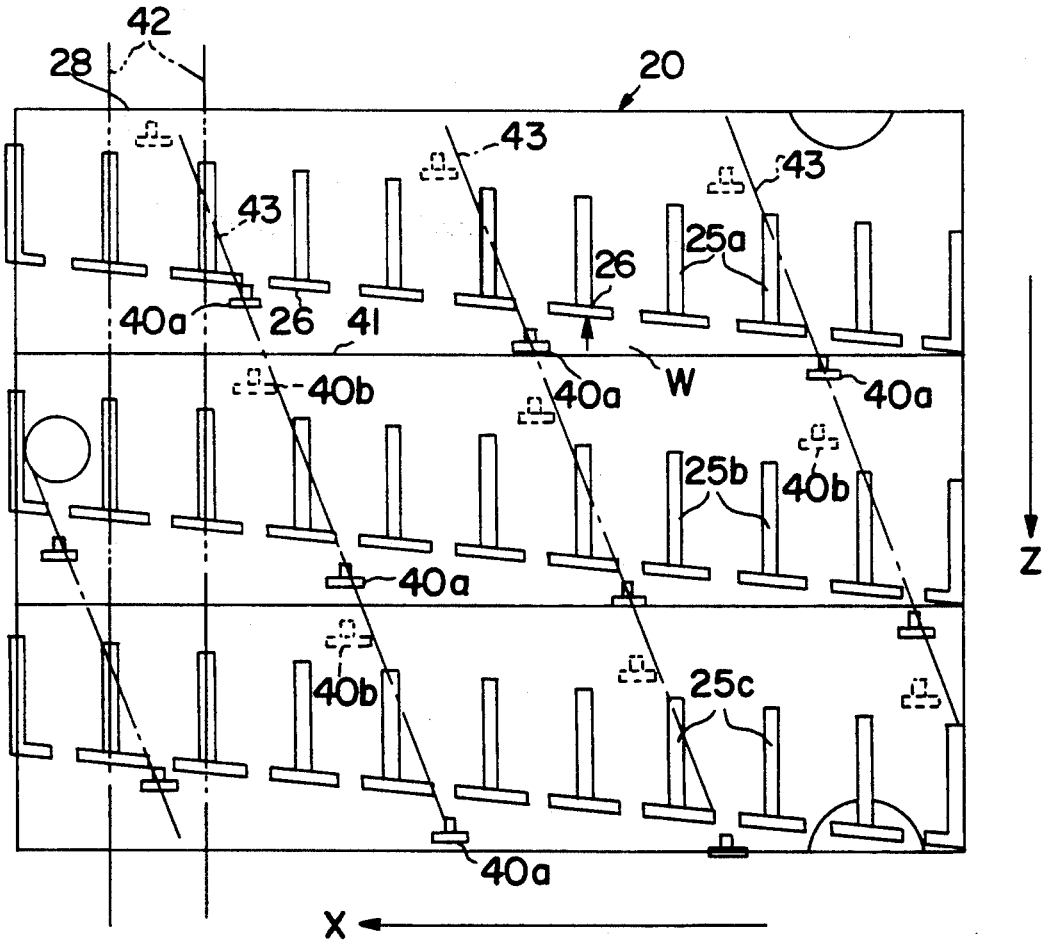
FIG. 2B shows a developed view illustrating the shaft of FIG. 2A.

In FIG. 2, the relationship of disk element 25 to disk bar 26 to the kneading counter-element 33 is shown in more detail and, in particular, the arrangement of the kneading bars 40 is also illustrated. An essential aspect for the purposes of the present invention is the arrangement of the kneading bars 40 in relation to the disk elements 25. In particular, the ratio of the kneading bars 40 to the disk elements on the kneader shaft 20 is important, the respective projected development of the kneader shaft 20 in the second part of the figures which follow providing the best impression of this. The direction of rotation z of the kneader shaft is indicated and so too is the axial direction of transport x from the inlet nozzle 3 to the outlet nozzle 4 (not shown in any further detail).

.In the illustrative embodiment according to FIG. 2, three disk elements 25*a*, 25*b* and 25*c* are arranged in each disk plane. The respective disk bars 26 are set at a specific angle w to a line 41 which is parallel to the axis, as a result of which transporting already takes place in direction x from the inlet nozzle to the outlet nozzle.

The kneading bars 40 are located between two planes of disk elements 25 in each case, two of these planes being indicated by way of example in FIG. 2 by dot-dashed lines and identified by the reference numeral 42.

As stated above, the kneading bars 40 are located between two disk planes 42 and in each case in the region there between successive disk elements 25, these kneading bars 40 being able to assume a variable position In the one position shown, the kneading bars 40 are located in such a way that they are running slightly ahead of two disk elements 25, i.e. close to disk bars 26. In the present illustrative embodiment, these kneading bars are identified by 40*a*.

In another position, indicated by dashed lines, the kneading bars 40*b* are located in such a way that they are running behind the disk elements 25, so that they are relatively far away from the disk bars 26 of the following disk elements. This possibility of positioning the kneading bars 40 in the region between two disk elements 25*a* and 25*b* is identified in FIG. 2 by the angle $\alpha$.

Furthermore, the offset of the kneading bars 40 of one kneading chamber 28 with respect to a next kneading chamber 28, between two disk planes 42 in each case, is important. According to FIG. 2, the offset takes place against the direction of rotation z, in which case the offset is referred to as positive. The offset is also indicated by the respectively dot-dashed lines 43. This arrangement speeds up the transporting of products in the direction of transport x.

The number of disk elements 25 is in the example three per disk plane 42. Consequently, with a regular arrangement, there is an angle offset $\gamma$ of 120° between the disk elements 25.

Figure 3A:
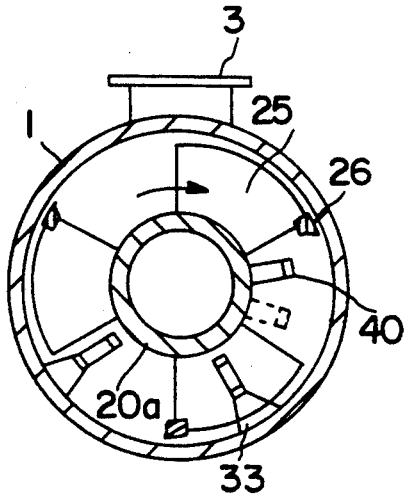
FIGS. 3A, 3B, 4A, 4B, 5A, 5B, 6A, 6B, 7A, 7B, 8A, 8B, 9A, 9B, 10A, 10B, 11A and 11B, show cross sections and developed views similar to FIGS. 2A and 2B of various embodiments of mixing kneaders.
Figure 3B:
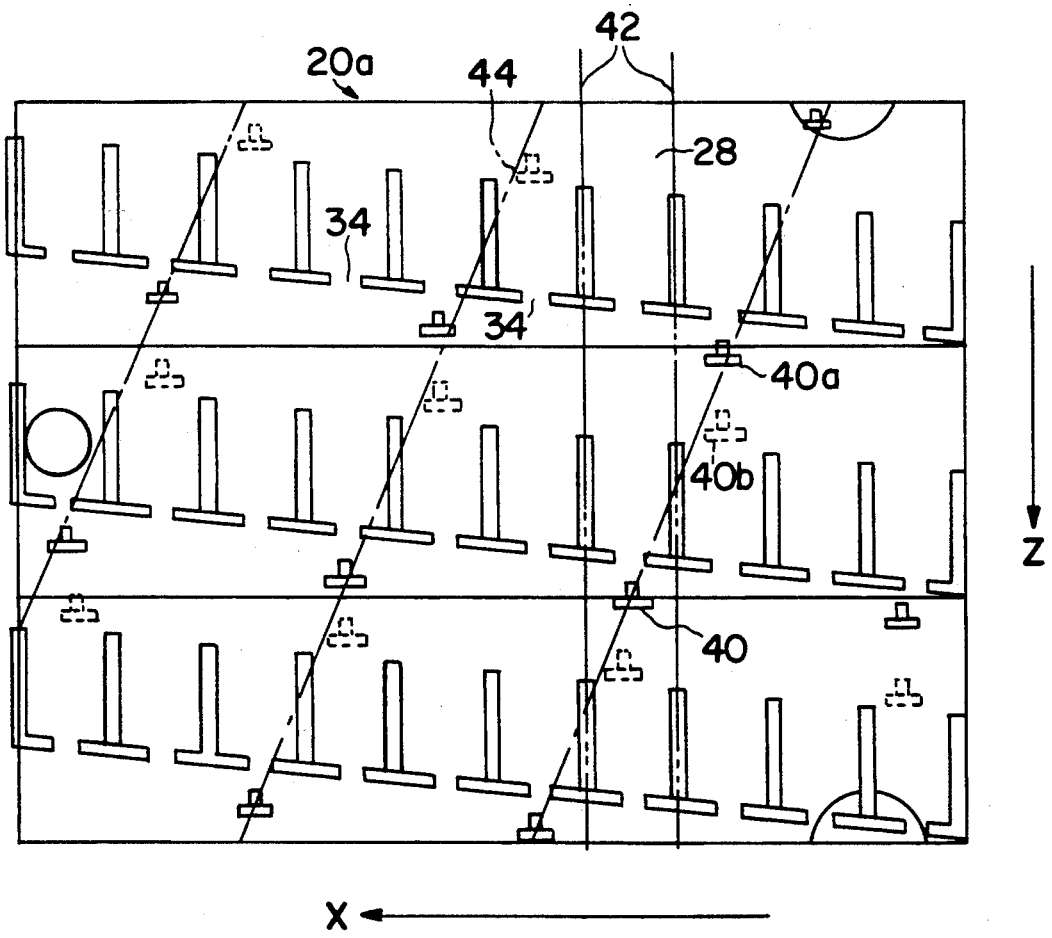

In the case of the kneader shaft 20*a* according to FIG. 3, the arrangement of disk elements 25 and kneading counter-elements 33 is the same as in the case of FIG. 2. However, the two illustrative embodiments differ with regard to the positioning of kneading bars 40 with respect to disk elements 25 and gaps 34. The kneading bars 40*a* are in this case arranged offset successively in the kneading direction z, to be precise between two disk planes 42, from kneading chamber 28 to kneading chamber 28 in the direction of transport x. Consequently, a negative offset line 44 is produced, as is indicated by dot-dashed lines. The arrangement of the kneading bars 40 takes place here as leading kneading bars 40*a* or as trailing kneading bars 40*b* which are only represented by dashed lines. It is clearly recognizable in the case of this configuration that the transporting action is more negative than in the case of the illustrative embodiment according to FIG. 2. In the case of the illustrative embodiment according to FIG. 2, each kneading bar is followed in the direction of rotation likewise by a kneading bar in the following kneading chamber 28 between two disk elements.

The product, as it were, transferred from kneading bar to kneading bar, thereby speeding up transporting.

In the present illustrative embodiment according to FIG. 3, on the other hand, a kneading bar 40 is followed in the direction of transport x in the following kneading chamber 28 between two disk elements 42 only by a gap 34 without a kneading bar In this case, the product is consequently not transferred from kneading bar to kneading bar, thereby slowing down transporting.

Figure 4A:
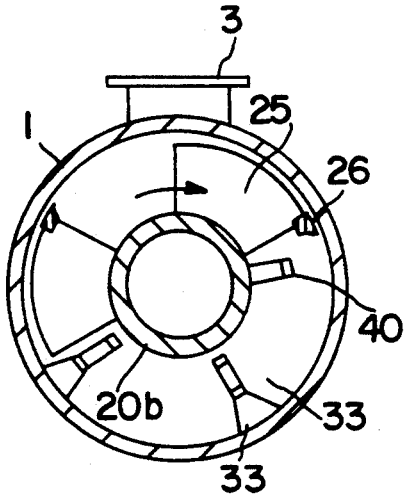
Figure 4B:
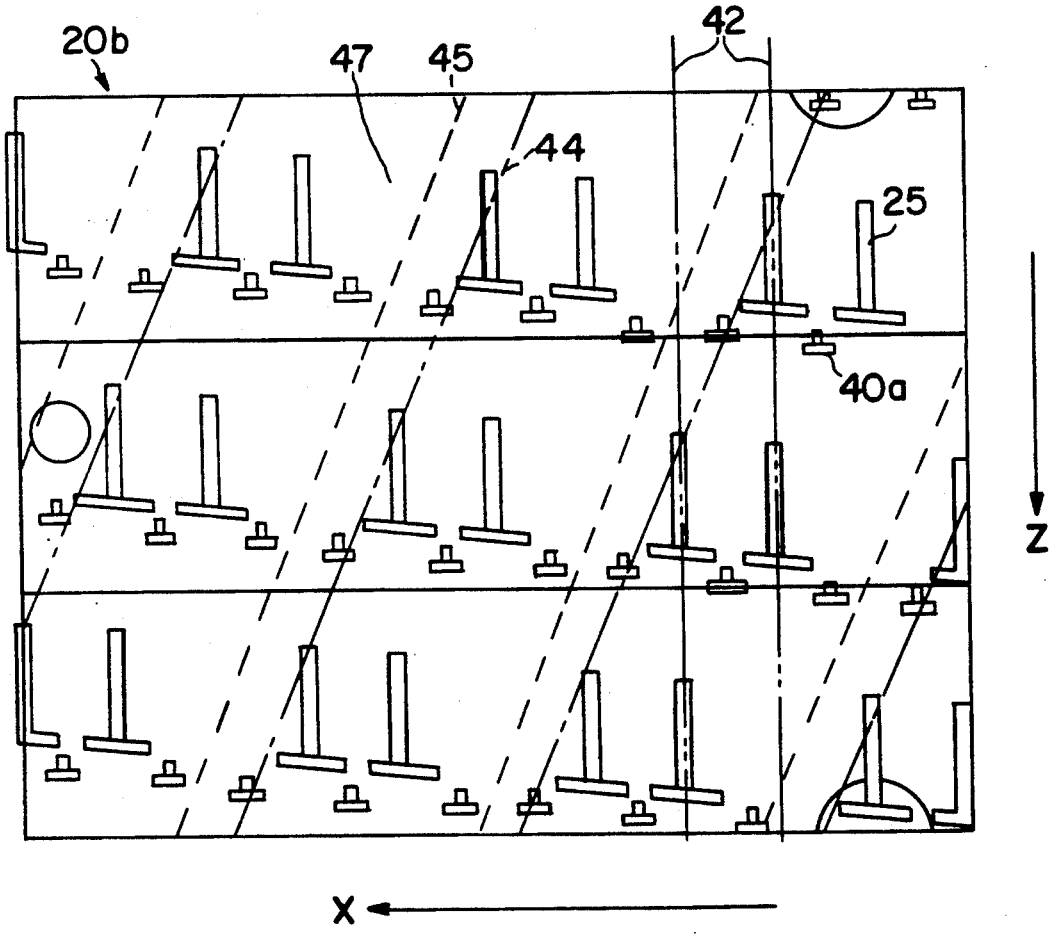

A further possibility of assigning kneading bars 40 to disk elements 35, and consequently influencing the axial transport, the dwell time and the intensity of the mixing and kneading action is shown in FIG. 4. In the case of this illustrative embodiment, a multiplicity of kneading bars are provided, whereas one disk element per disk plane 42 has been omitted The gap which the disk element leaves in each case in the disk plane 42 is identified as sector 47 and, in the case of this illustrative embodiment, follows in the direction of rotation z successively from kneading chamber 28 to kneading chamber 28, as is represented by the dashed line 45. This line is referred to as a negative sector line. The offset line 44 of the kneading bars is also negative, so that in the case of this illustrative embodiment the transporting of the product is considerably reduced. Otherwise, there are here in each kneading chamber 28 three leading kneading bars 40*a*, the possibility of arranging trailing kneading bars not being indicated here. Wherever the omission of a disk element produces a gap or sector 47 between two disk elements 25, two kneading bars 40 are provided in each case in this sector 47.

In the case of the illustrative embodiment of how a kneader shaft 20*c* is equipped according to FIG. 5, again a sector 47 is provided between disk elements 25. However, this sector 47 is now arranged against the direction of rotation z in successive kneading chambers 28, so that here there is a positive sector line 46, which positively influences product transport. The product is, as it were, passed on from sector to sector when the shaft is turned in the direction of rotation z.

In the case of this illustrative embodiment, the kneading bars are again provided only singly per sector and are arranged on a negative offset line 44. This means that in this case the product is on the one hand subjected to positive transporting in the sectors and on the other hand to negative transporting by the arrangement of the kneading bars 40. It is evident that this significantly improves and increases the axial mixing and kneading of the product.

Figure 6A:
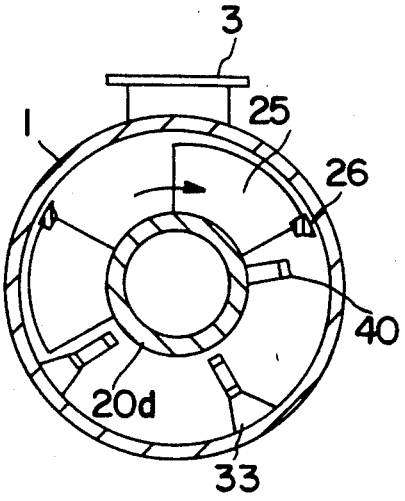
Figure 6B:
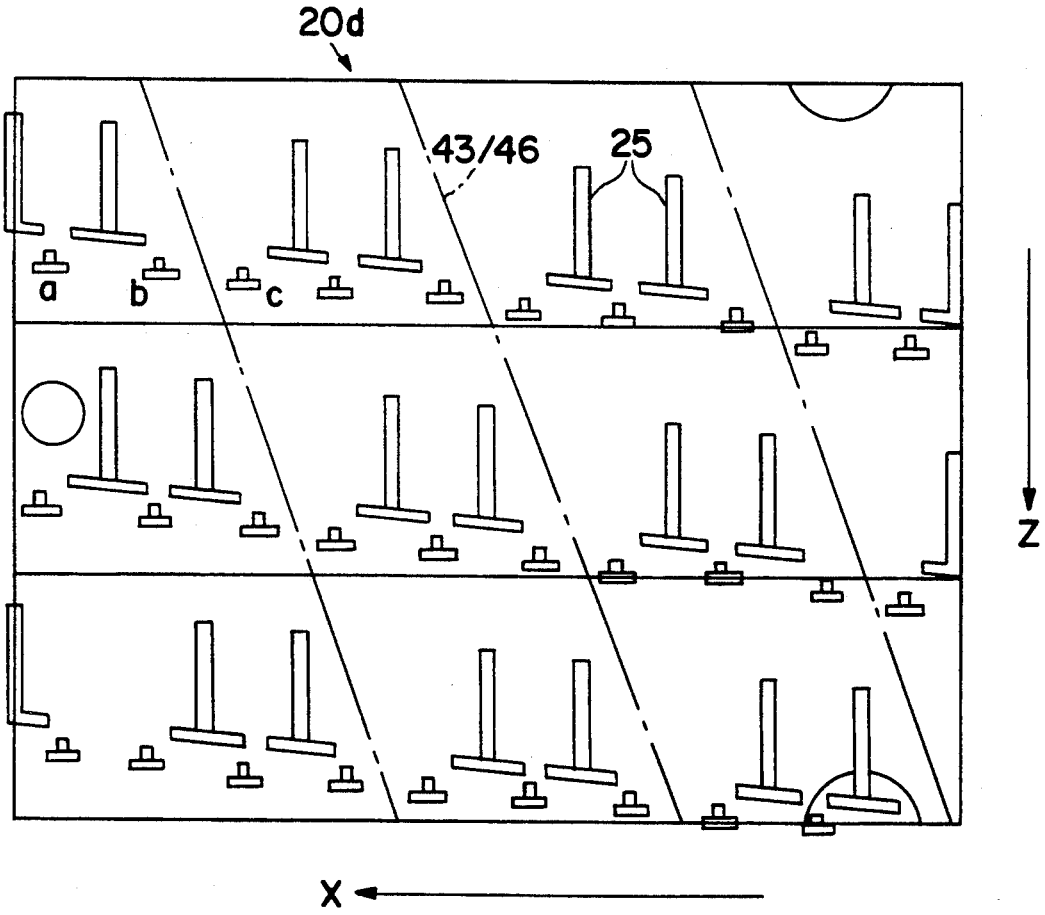

In the case of the illustrative embodiment of a kneader shaft 20*d* according to FIG. 6, both the sectors between two disk elements 25 and the kneading bars 40 are located on a positive offset and sector line 43/46. As a result, very good evasive movements of the product in the direction of transport x are possible, so that the axial transporting and, at the same time, the kneading of the product are influenced very positively.

Figure 5A:
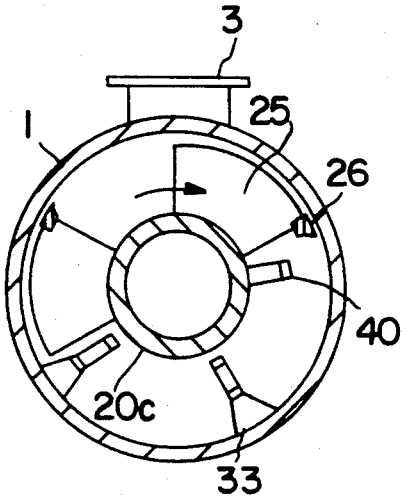
Figure 5B:
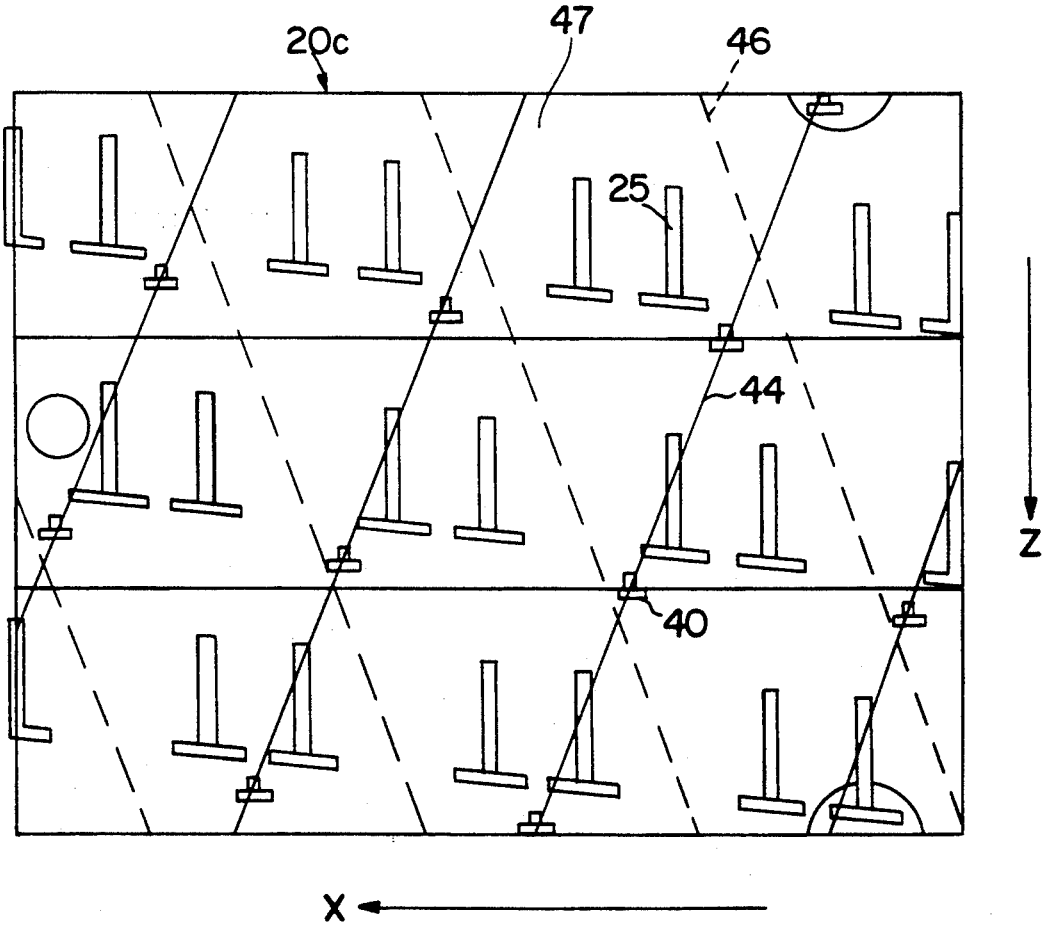
Figure 7A:
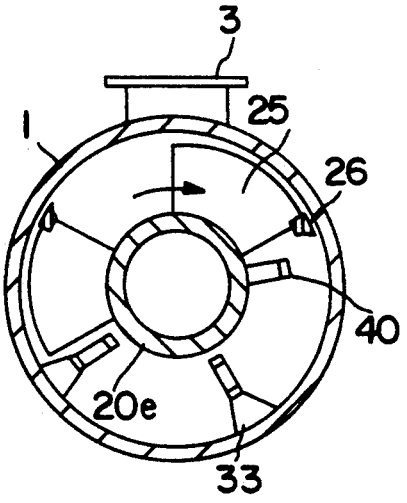
Figure 7B:
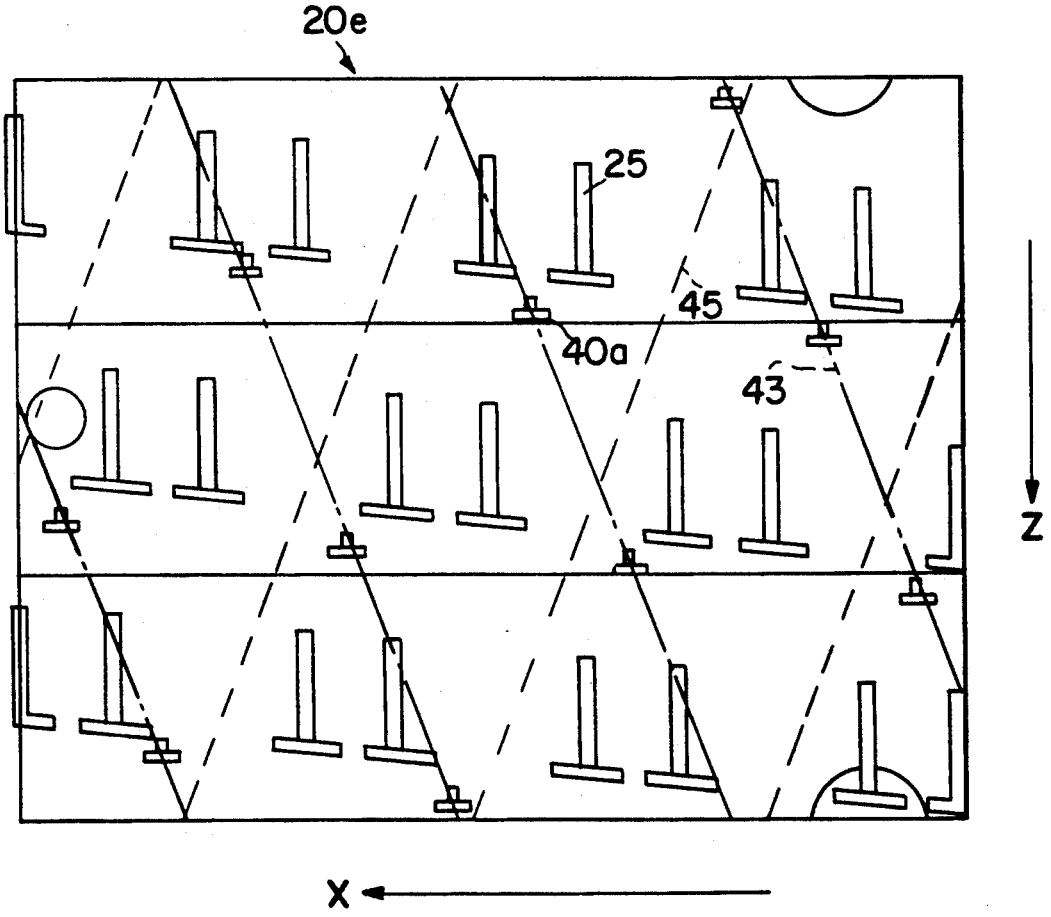

In the case of an illustrative embodiment of a kneader shaft 20*e* according to FIG. 7, the arrangement is reversed in relation to the illustrative embodiment according to FIG. 5.

According to FIG. 7, the sectors are arranged in the direction of rotation on a negative sector line 45, whereas the kneading bars 40 are located on a positive offset line 43. Although the transporting of the product is speeded up in the direction of transport x by the positive offset line 43, it is however slowed down by the negative arrangement of the sectors on the sector line 45. This also has a positive effect on a desired kneading or mixing action.

Figure 8A:
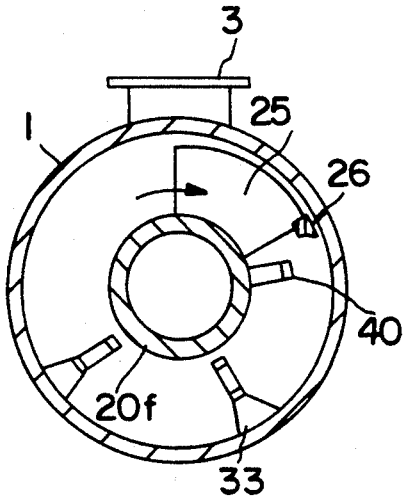
Figure 8B:
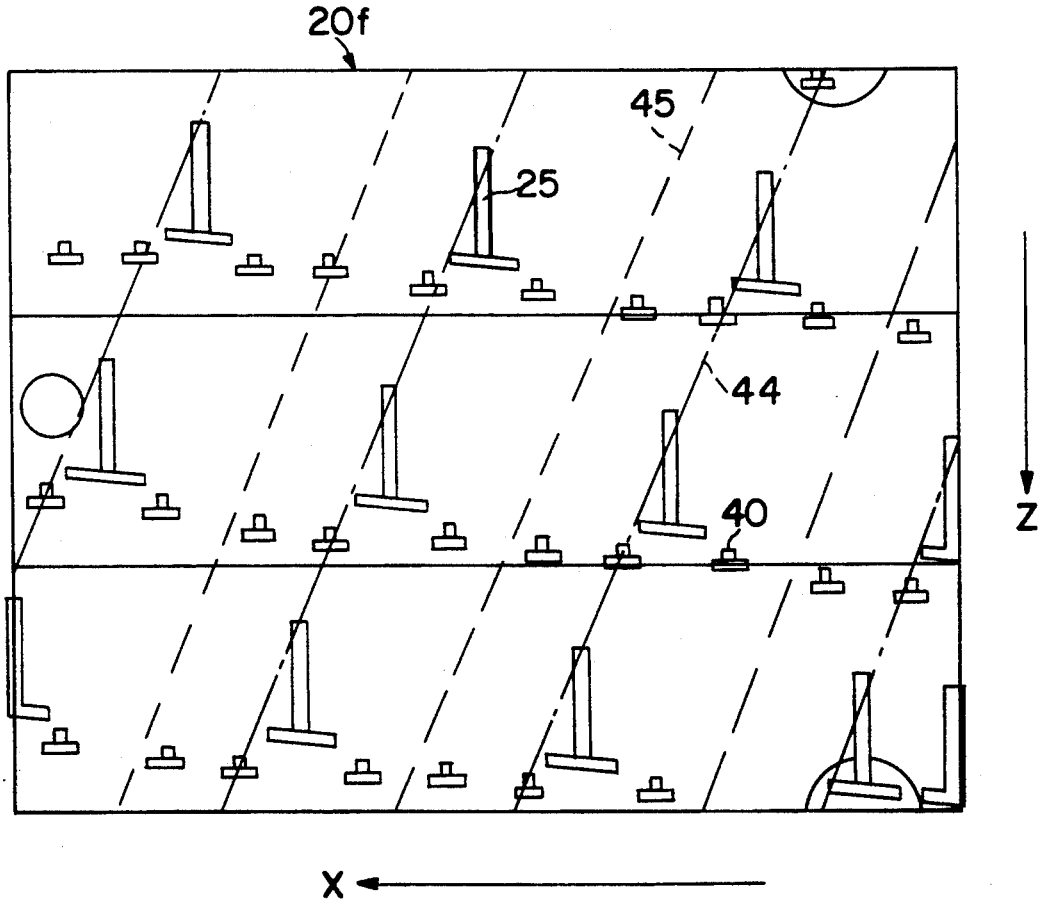

In the illustrative embodiment of a kneader shaft 20*f* in FIG. 8, two disk elements are omitted in each case per disk plane 42, to be precise in the direction of rotation, i.e. with a negative sector line 45. The kneading bars 40 are also arranged on negative offset lines 44. Consequently, the transporting of the product in the direction of transport x is doubly restrained, since kneading bars or disk elements keep getting in the way of the product. It is self-evident that this again improves the kneading action. The free cross sections for the axial passage of exhaust vapors or gases are larger.

Figure 9A:
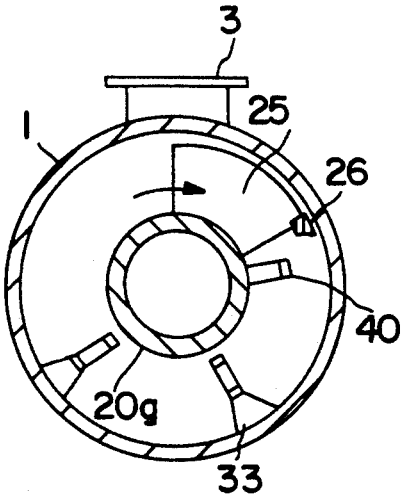
Figure 9B:
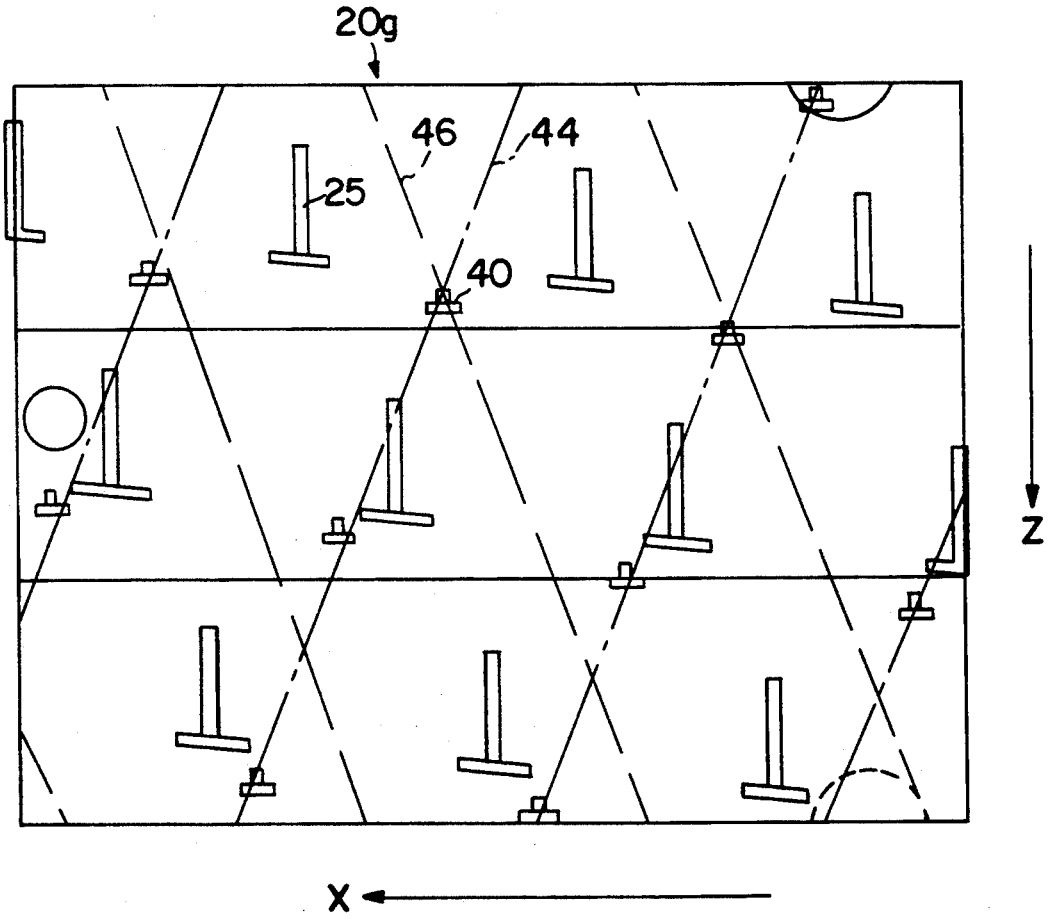

In the case of the illustrative embodiment of the kneader shaft 20*g* according to FIG. 9, the sectors between the disk elements 25 are arranged on a positive sector line 46, whereas the kneading bars 40 are located on a negative offset line 44. This means in part an improvement in the transporting of the product, but on the other hand again a restraint, as a result of which the kneading action is improved in the region of the restraint.

In contrast to the illustrative embodiment according to FIG. 8, here mention must also be made of the reduction in the number of kneading bars. Whereas in the case of the illustrative embodiment according to FIG. 8 three kneading bars were in each case arranged between two disk elements, in the case of the illustrative embodiment according to FIG. 9 there is only one kneading bar between two disk elements, two kneading bars of three successive kneading chambers in each case being situated close to a disk element, whereas the third kneading bar in the third kneading chamber is located almost exactly between the two remaining disk elements. In spite of this reduction in the number of kneading elements, the requirement for substantial self-cleaning in interaction with the static kneading elements is met, as in the case of all the examples.

Figure 10A:
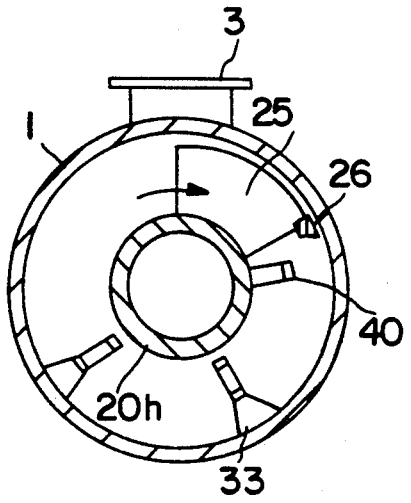
Figure 10B:
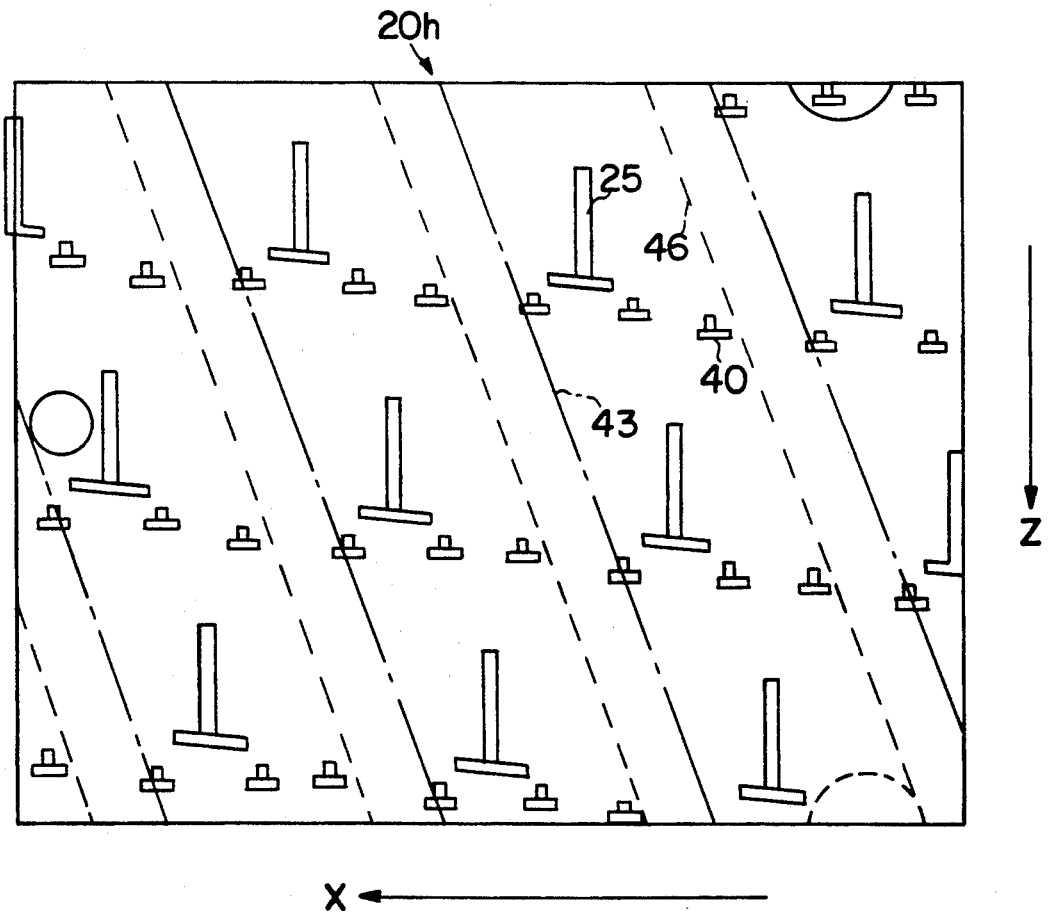

The illustrative embodiment of the kneader shaft **20*h* in FIG. 10 is the counterpart of the illustrative embodiment according to FIG. 8, in this case both sectors and kneading bars being provided on a positive offset line 43 and positive sector line 46**. Again, there are three kneading bars in each case between the individual disk elements.

Figure 11A:
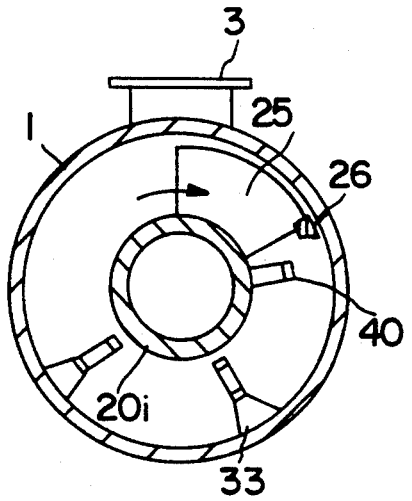
Figure 11B:
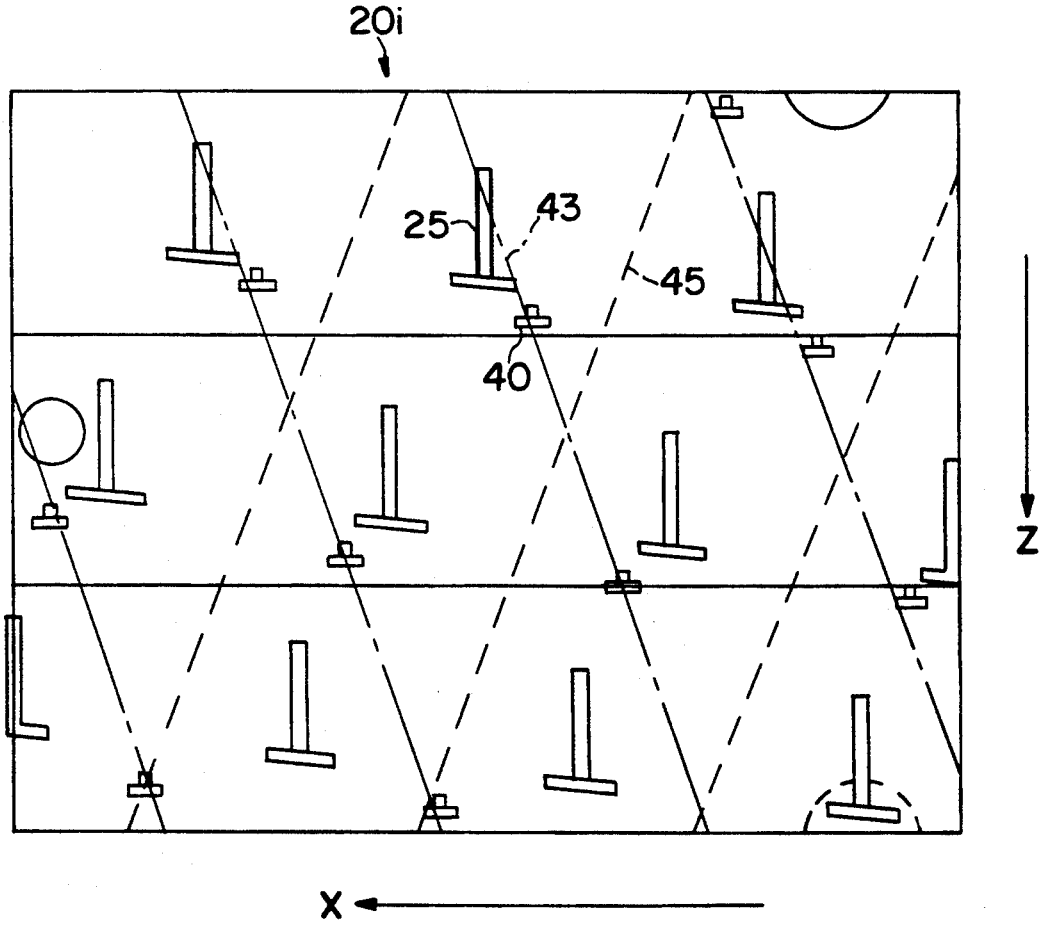

As the last illustrative embodiment, in FIG. 11 a kneader shaft **20*i* is shown which represents the counterpart of the kneader shaft 20*g* in FIG. 9. In the case of this kneader shaft 20*i*, the kneading bars 20 are located on a positive offset line 43 and the sectors between the disk elements are located on a negative sector line 45. Although product transport is improved by the positive offset line 43 of the kneading bars, it is in turn restrained by the negative arrangement of the sectors on the negative sector line 45**.

We claim:

1. A continuously operating mixing kneader for the thermal or chemical treatment of products in liquid, pasty or pulverulent state or combinations thereof, which comprises: a housing; a kneader shaft arranged in the housing, running axially and concentrically therein; disk elements and kneading bars on said shaft; wherein, said shaft rotates about an axis of rotation (2) and effects the transportation of product in the housing in a direction of transport (x); counter-elements provided between the disk elements fixed to the housing; said disk elements being arranged in planes perpendicular to the kneader shaft, forming free sectors between disk elements defining kneading chambers; wherein the kneading bars are arranged on a line offset with respect to the kneading chambers selected from the group consisting of a positive offset line and a negative offset line, wherein in the case of a positive offset line each kneading bar assigned to two disk elements is followed against the direction of rotation (2) by a kneading bar assigned to the next two disk elements of the kneading chamber following in the direction of transport (x), whereas in the case of a negative offset line each kneading bar assigned to two disk elements is followed in the direction of rotation (2) by a kneading bar assigned to the next two disk elements of the kneading chamber following in the direction of transport (x).

2. The mixing kneader of claim 1, wherein the kneading bars are arranged in the kneading chambers in such a way that they are respectively running ahead of the disk elements.

3. The mixing kneader of claim 1, wherein the kneading bars are arranged in the kneading chambers in such a way that they are respectively running behind the disk elements.

4. The mixing kneader of claim 1, wherein three disk elements are arranged in each of said plane.

5. The mixing kneader of claim 4, wherein the disk elements are arranged within a plane at a line offset at 120° with respect to the kneading chamber.

6. The mixing kneader of claim 1, wherein at least one disk element is arranged in a plane in such a way that major sectors between disk elements remain free.

7. The mixing kneader of claim 6, wherein the major sectors remaining free lie on a sector line selected from the group consisting of positive and negative sector lines, wherein in the case of a positive sector line the major sectors of adjacent kneading chambers follow one another counter to the direction of rotation (z) and in the direction of transport (x), whereas a negative sector line runs in the direction of rotation (z) and in the direction of transport (x).

8. The mixing kneader of claim 7, wherein, in each kneading chamber each disk element is assigned a kneading bar.

9. The mixing kneader of claim 8, wherein, within the major sectors, in each case two kneading bars are adjacent and adjoined axially by a disk element.

10. The mixing kneader of claim 7, wherein in each kneading chamber only one kneading bar is provided, the one kneading bar being arranged between two adjacent disk elements, whereas the kneading bar following said one kneading bar is arranged, seen radially, closer to the next disk element, and the following kneading bar is arranged, seen radially, close to another disk element.

11. The mixing kneader of claim 6, wherein the arrangement of the major sectors along the kneader shaft is configured differently in zones, in each case comprising one or more sections.

12. The mixing kneader of claim 1, wherein the arrangement of the kneading bars along the kneader shaft is configured differently in zones, in each case comprising one or more sections.

* * * * *